US005768979A

United States Patent [19]

Antoine

[11] Patent Number: 5,768,979

[45] Date of Patent: Jun. 23, 1998

[54] PROCESS FOR ASSEMBLING A COOKING UNIT PLATE WITH ITS SUPPORT AND RESULTING COOKING UNIT

[75] Inventor: Dominique Antoine, Cleurie, France

[73] Assignee: SEB S.A., Ecully, France

[21] Appl. No.: 551,404

[22] Filed: Nov. 1, 1995

[30] Foreign Application Priority Data

Nov. 2, 1994 [FR] France ..... 94 13412

[51] Int. Cl.[6] ..... H05B 3/68; F24C 15/10; F24C 3/00

[52] U.S. Cl. ..... 99/422; 99/449; 99/339; 219/464; 219/467; 126/39 B; 126/211; 126/39 H

[58] Field of Search ..... 99/422, 339, 349, 99/449; 219/464, 467; 126/39 B, 211, 39 H

[56] References Cited

U.S. PATENT DOCUMENTS

| | | | |
|---|---|---|---|
| 4,262,820 | 4/1981 | Flint | 126/231 X |
| 4,492,217 | 1/1985 | Scheidler | 126/39 B |
| 5,046,477 | 9/1991 | Bennett et al. | 126/39 B |
| 5,047,252 | 9/1991 | Liu et al. | 99/323 X |
| 5,317,129 | 5/1994 | Taplan et al. | 219/464 |
| 5,399,839 | 3/1995 | Taplan et al. | 126/39 B X |

FOREIGN PATENT DOCUMENTS

| | | |
|---|---|---|
| 0 567 779 A1 | 3/1993 | European Pat. Off. . |
| 2 424 486 | 11/1979 | France . |
| 26 47 180 A1 | 4/1978 | Germany . |
| 43 18 854 C1 | 6/1994 | Germany . |

*Primary Examiner*—Reginald L. Alexander
*Attorney, Agent, or Firm*—Loeb & Loeb LLP

[57] ABSTRACT

In a cooking device composed of a frame for receiving a heating element, the device further including a cooking plate supported on the frame and elements for fixing the cooking plate to the frame, the fixing elements are constituted by at least one adhesive band having two active adhesive surfaces, with a first one of the adhesive surfaces contacting and adhering to the frame and a second one of the adhesive surfaces contacting, and adhering to, the plate. A process for assembling a cooking device composed of a cooking plate and a frame, the process including the steps of providing at least one adhesive band having two opposed active adhesive surfaces, and assembling the cooking plate to the frame with the at least one adhesive band interposed between the cooking plate and the frame such that a first one of the active adhesive surfaces is fixed to the frame and a second one of the active adhesive surfaces is fixed to the cooking plate.

16 Claims, 1 Drawing Sheet

PROCESS FOR ASSEMBLING A COOKING UNIT PLATE WITH ITS SUPPORT AND RESULTING COOKING UNIT

BACKGROUND OF THE INVENTION

The present invention relates to the general field of cooking appliances and more particularly to cooking appliances, or devices, comprising a vitroceramic, or glass ceramic, cooking plate.

The invention is directed to a process for assembling cooking devices and in particular a process for assembling and assembly means for fixing the cooking plate upon its support.

It is already known to fabricate cooking appliances comprising a glass ceramic cooking plate by utilizing, for example, metal rings intended to fix the glass ceramic plate onto its support. The utilization of rings is particularly disadvantageous, given that it requires additional pieces as well as a relatively complex assembly process. In addition, the fabrication cost is relatively high.

The prior art also describes the utilization of silicone adhesive to bond the cooking plate onto its support. The difficulty presented by the utilization of silicone adhesive resides in the particularly long drying time of such adhesive. Cooking appliances or devices which are thus assembled must be handled with care as long as the silicone adhesive is not dry.

SUMMARY OF THE INVENTION

An object of the present invention is to provide fixing means which permit an instantaneous connection of the cooking plate on its support in the cooking device manufacturing process.

Another object of the present invention is to achieve, in a particularly simple and rapid manner, the fixing of the glass ceramic cooking plate onto its support without incurring a supplemental fabrication cost.

The above and other objects are achieved, according to the present invention, in a cooking device comprising a frame for receiving a heating means, the device further including a cooking plate supported on the frame and means for fixing the cooking plate to the frame, by the improvement wherein the attachment means are constituted by at least one adhesive band having two active adhesive surfaces, with a first one of the adhesive surfaces contacting, and adhering to, the frame and a second one of the adhesive surfaces contacting, and adhering to, the plate.

The objects of the present invention are further achieved by a process for assembling a cooking device comprising a cooking plate and a frame, the process comprising providing at least one adhesive band having two opposed active adhesive surfaces, and assembling the cooking plate to the frame with the at least one adhesive band interposed between the cooking plate and the frame such that a first one of the active adhesive surfaces is fixed to the frame and a second one of the active adhesive surfaces is fixed to the cooking plate.

The characteristics and advantages of the invention will become more readily apparent from a reading of the description presented hereafter with reference to the attached drawings which provide a non-limiting illustration of an exemplary embodiment of the invention.

DESCRIPTION OF THE PREFERRED EMBODIMENTS

Figure 1:
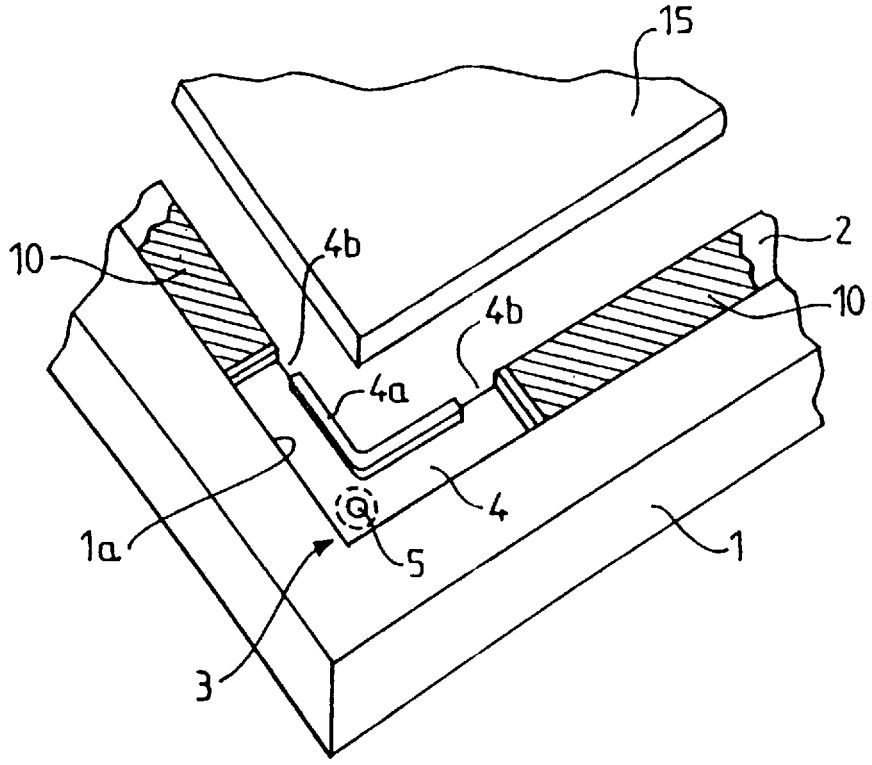
FIG. 1 is an exploded, perspective, detail view of a preferred embodiment of the components of a cooking device according to the present invention.
Figure 2:
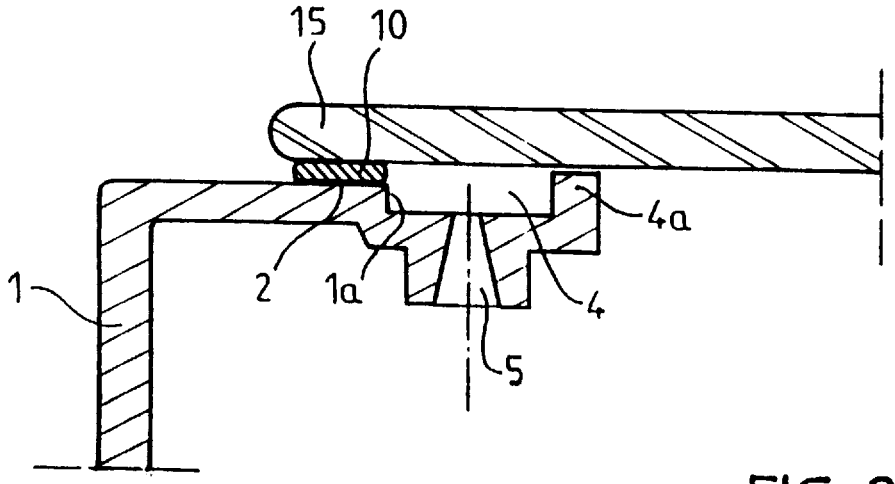
FIG. 2 is a cross-sectional detail view of a cooking device according to a second embodiment of the invention.

The cooking device shown in FIGS. 1 and 2 includes a frame 1 having heating means and temperature regulating means (not shown) disposed on or within frame 1.

In FIG. 1, the frame 1 is covered, at least partially, by a glass ceramic cooking plate 15 which is fixed onto frame 1 with the aid of fixation means. The fixation means are constituted by adhesive bands 10 having two active adhesive surfaces which come in contact with frame 1 and plate 15, respectively. The adhesive bands 10 are formed, for example, from double face adhesive strips, or ribbons, which permit plate 15 to be instantaneously fixed, or adhered, to frame 1 as soon as plate 15 comes into contact with adhesive bands 10 during assembly of the cooking device. The fixation means are preferably associated with a silicone cement of the silicone mastic type, a mastic being an adhesive initially having a putty-like consistency.

Advantageously, adhesive bands 10 are distributed along a support periphery 2 of frame 1 on which plate 15 rests, in a manner to establish an interface between frame 1 and plate 15. The support periphery 2 is, for example, a simple support surface of frame 1 obtained by molding, or is an upper lateral wall of frame 1 on which plate 15 rests.

Advantageously, support periphery 2 has a configuration extending in a projection plane parallel to the projection plane of plate 15 in a manner to achieve an intimate bond between frame 1 and plate 15, by the intermediary of adhesive bands 10. The support periphery 2 has a series of cavities 4 arranged at regular or irregular intervals in frame 1. The adhesive bands 10 are disposed in the intervals between cavities 4, while the silicone adhesive is applied in the cavities 4. The plate 15 rests, thus, alternatingly on raised portions provided with adhesive bands 10 and above cavities 4 filled with silicone adhesive, as shown in FIG. 2. The cavities 4 are produced, for example, during molding of frame 1 and are in the form of open grooves, or recesses, which can easily receive material of the silicone adhesive type between an inwardly facing peripheral edge 1*a* of frame 1 and an internal peripheral edge 4*a* of frame 1. The silicone adhesive thus fills a volume of each cavity 4 delimited by the peripheral edge 1*a,* the internal peripheral edge 4*a,* the bottom of cavity 4 and the portion of plate 15 covering that cavity 4. In addition, the volume filled by this silicone adhesive is delimited by adjacent raised portions of support periphery 2 which are covered by adhesive bands 10.

According to a preferred embodiment of a device according to the invention, the plate 15, as well as the support periphery 2, have a rectangular or square configuration and the cavities 4 are disposed in the vicinity of the corners 3 of the support periphery 2.

According to another embodiment of a device according to the invention, the plate 15 can have a circular form, as can the support periphery 2. The cavities 4 then have the form of circular arcs alternating with adhesive bands 10 also having the form of circular arcs.

Advantageously, each cavity 4 is provided with at least one opening 5 via which the silicone adhesive can be introduced into cavity 4. The openings 5 preferably widen downwardly toward the internal volume of frame 1. Each cavity 4 thus has at least one opening for injecting the silicone adhesive into the cavity 4, as well as evacuation openings 4*b* which are calibrated to assure complete evacuation of air contained in each cavity 4 during injection of the silicone adhesive.

Advantageously, openings 5 have a conical form to facilitate the injection operation. Such operation is performed under a pressure whose value is determined, inter alia, by the size of openings 4*b* in a manner to fill the entire accessible free volume of each cavity 4. The calibration, or dimensioning, of openings 4*b* is easily determinable by experimentation and thus permits control of the evacuation of the air contained in each cavity 4 in a manner to obtain a hermetically sealed joint or interface between the adhesive bands 10 and the silicone adhesive. This is particularly desirable in the case where the adhesive bands 10 do not completely cover the intervals of support periphery 2 which extend between cavities 4 and to which are adhered the adhesive bands 10. The openings 4*b* equally permit observation of the completion of the silicone adhesive injection operation, when the silicone adhesive begins to escape via the openings 4*b*.

According to another embodiment of the invention, shown in FIG. 2, the support periphery 2 is provided with an adhesive band 10 which extends around the entire periphery of frame 1, thus coming in contact, and adhering to, plate 15 along a continuous line. The cavities 4 extend in this embodiment completely or partially along the support periphery 2, along the interior edge of support periphery 2 in a manner to form a second bonding, or cementing, zone adjacent to adhesive bands 10 when the silicone adhesive is introduced into the cavity 4. Such a configuration is easily realizable during molding of frame 1.

Advantageously, frame 1 is made of a plastic material having a good high temperature resistance. Alternatively, frame 1 can be made of metal.

Other variations of the configuration and arrangement of cavities 4 and of support periphery 2 can equally be envisioned without departing from the framework of the present invention. Thus, it is possible to increase the number of cavities 4 and to position them along the lateral walls of the frame, or to increase the size, and particularly the depth, of cavities 4. It is moreover possible to increase or reduce the surface area of adhesive bands 10 as a function of the mechanical stress that will be imposed on the assembly of plate 15 and frame 1.

The invention concerns equally a process for assembling a cooking device composed of frame 1 and plate 15. The process consists in utilizing fixing means for fixing plate 15 on frame 1, and in utilizing adhesive bands 10 having two active cementing, or bonding, surfaces as the fixing means. The assembly process also consists in distributing adhesive bands 10 along support periphery 2 of frame 1 on which plate 15 rests in order to create the interface between plate 15 and frame 1. The assembly process according to the invention then consists in utilizing silicone adhesive of the silicone mastic type, in association with adhesive bands 10, and in injecting this silicone adhesive into the cavities 4 formed in support periphery 2 of frame 1.

The assembly process consists, in addition, in introducing the silicone adhesive into cavities 4 via openings 5. Openings 5 open at their upper ends, into each cavity 4 and at their lower ends toward the accessible internal space of frame 1. Thus, plate 15 of the glass ceramic type is intimately joined to frame 1 by the intermediary of adhesive bands 10 before introduction of the adhesive means of the silicone adhesive type. The first attachment, with bands 10, which may be provisional, thus permits handling of the partially completed cooking device and, for example, allows it to be inverted in order to proceed with the filling of cavities 4 by the silicone adhesive. Thus, handling, or manipulation, of the cooking device becomes possible before drying of the silicone adhesive which can constitute the principal means for maintaining plate 15 attached to frame 1.

Cooking devices according to the invention are thus capable of being packaged, particularly before the silicone adhesive completely fulfills its attachment function.

The advantages of the cooking device according to the invention and of the process for assembling that device reside in the elimination of the mechanical parts generally utilized to fix a cooking plate onto a frame.

Another advantage is obtained by the saving of time in the process for assembling the cooking device according to the invention while utilizing effecting attachment means to maintain plate 15 on its support.

An additional advantage of the assembly process according to the invention resides in its use in the field of cooking apparatus which is free standing or built-in and which produce cooking heat by radiation or induction.

A supplemental advantage of cooking devices according to the invention resides in the hermetic seal obtained between frame 1 and plate 15 as a result of the association of a silicone adhesive and adhesive bands 10, thus assuring that any liquid which is accidentally spilled onto plate 15 will not leak into the region enclosed by frame 1.

According to another embodiment of the invention, it is possible to provide in the support periphery 2 a channel extending along the entire perimeter of support periphery 2. The channel is intended to contain the silicone adhesive and thus constitutes a peripheral hermetic sealing joint between frame 1 and plate 15.

According to this embodiment, adhesive bands 10 are disposed on the support periphery 2 outside of the channel in a manner which is concentric to the channel.

The last-described embodiment could have the cross-sectional form shown in FIG. 2 and the channel could be associated with a plurality of openings 5 distributed around the periphery of frame 1.

This application relates to subject matter disclosed in French Application number FR-9413412, filed on Nov. 2, 1994, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

I claim:

1. In a cooking device comprising a frame for receiving a heating means, the device further including a cooking plate supported on the frame and means for fixing the cooking plate to the frame, the improvement wherein said fixing means are constituted by at least one double face adhesive strip having two active adhesive surfaces, with a first one of said adhesive surfaces contacting and adhering to said frame and a second one of said adhesive surfaces contacting, and adhering to, said plate.

2. Device according to claim 1, wherein said fixing means further comprise at least one body of a silicone adhesive.

3. Device according to claim 2, wherein said frame has a peripheral support surface for supporting said cooking plate, and there are a plurality of double face adhesive strips distributed around said peripheral support surface to create an interface between said frame and said cooking plate.

4. Device according to claim 3, wherein said peripheral support surface is provided with a series of cavities which are spaced apart along said peripheral support surface, said adhesive strips are disposed on said peripheral support surface at locations between said cavities, and said silicone adhesive is disposed in said cavities.

5. Device according to claim 4, wherein each of said cavities is provided with an opening for the injection of said silicone adhesive into said cavities, and each of said cavities is further provided with calibrated openings located to permit evacuation of air during injection of said silicone adhesive into said cavities.

6. Device according to claim 5, wherein said cooking plate and said peripheral support surface have the form of rectangles having corners, and said cavities are located in the region of said corners of said peripheral support surface.

7. Device according to claim 4, wherein said cooking plate and said peripheral support surface have the form of rectangles having corners, and said cavities are located in the region of said corners of said peripheral support surface.

8. Device according to claim 2, wherein said frame is provided with a peripheral support surface which supports said cooking plate, said support surface is provided with a channel which extends completely around said frame and which contains said silicone adhesive, and said adhesive band is disposed on said peripheral support surface, said adhesive strip surrounding, and being parallel to, said channel.

9. Device according to claim 1, wherein said device forms part of a free standing induction cooking apparatus.

10. Device according to claim 1, wherein said cooking plate is made of a glass ceramic material.

11. A process for assembling a cooking device comprising a cooking plate and a frame, said process comprising providing at least one adhesive band constituted by a double face adhesive strip having two opposed active adhesive surfaces, and assembling the cooking plate to the frame with the at least one adhesive strip interposed between the cooking plate and the frame such that a first one of the active adhesive surfaces is fixed to the frame and a second one of the active adhesive surfaces is fixed to the cooking plate.

12. A process according to claim 11, wherein said step of providing comprises providing a plurality of double face adhesive strips, and said step of assembling comprises distributing the adhesive strips along a support surface of the frame and then placing the cooking plate on the frame so that the cooking plate contacts and adheres to the adhesive strips.

13. A process as defined in claim 12 further comprising providing the peripheral support surface with cavities and injecting a silicone adhesive into the cavities in order to bring the adhesive into contact with the frame and the cooking plate to further secure the cooking plate to the frame.

14. A process according to claim 13, wherein the frame encloses an internal space and said step of injecting silicone adhesive is performed by injecting the silicone adhesive via openings which open at one end into the cavities and at the other end into the internal space.

15. A process according to claim 11, wherein the frame is provided with cavities which face portions of the cooking plate and further comprising injecting a silicone adhesive into the cavities to cause the silicone adhesive to contact the frame and the cooking plate and to further secure the cooking plate to the frame.

16. A process according to claim 15, wherein the frame encloses an internal space and said step of injecting silicone adhesive is performed by injecting the silicone adhesive via openings which open at one end into the cavities and at the other end into the internal space.

* * * * *